US005745819A

United States Patent [19]

Donaldson et al.

[11] Patent Number: 5,745,819

[45] Date of Patent: Apr. 28, 1998

[54] REPRODUCTION MACHINE HAVING IMAGE DELETIONS REDUCING CONTROL SYSTEM AND METHOD

[75] Inventors: Patricia J. Donaldson, Pittsford; Darryl L. Pozzanghera, Rochester, both of N.Y.

[73] Assignee: Xerox Corporation, Stamford, Conn.

[21] Appl. No.: 787,187

[22] Filed: Jan. 21, 1997

[51] Int. Cl.[6] ..... G03G 15/00; G03G 15/18

[52] U.S. Cl. ..... 399/43; 399/72; 399/138; 399/253

[58] Field of Search ..... 399/29, 43, 138, 399/264, 222, 127, 130, 72, 253

[56] References Cited

U.S. PATENT DOCUMENTS

| | | | |
|---|---|---|---|
| 4,078,929 | 3/1978 | Gundlach | 96/1.2 |
| 5,010,367 | 4/1991 | Hays | 355/247 |
| 5,655,185 | 8/1997 | Hori et al. | 399/138 |

*Primary Examiner*—Joan Pendegrass
*Attorney, Agent, or Firm*—Tallam Nguti

[57] ABSTRACT

An electrostatographic reproduction machine that includes an image bearing member means for forming a latent image having image areas and background areas; at least a development housing containing charged carrier beads, charged fragments of the charged carrier beads which undesirably cause image deletions, and charged toner particles for developing image areas to form a toner image; means for transferring the toner image to a sheet of paper, and means for fusing the toner image to the sheet of paper. Importantly the reproduction machine includes a method and control system for reducing halftone image deletions in future halftone images. The method and control system include means for distinguishing latent solid image patterns from latent halftone image patterns; means for counting a number of solid image patterns developed with toner on the image bearing surface; means for providing an electrostatic halftone stress image pattern for electrostatically forming and developing on the image bearing surface; and means for forming and developing a number of the halftone stress image patterns on the image bearing surface, under certain machine operating conditions, so as to attract charged fragments of the charged carrier beads out of the development housing, thereby reducing deletions that would otherwise be undesirably caused by the carrier bead fragments in future halftone toner images

10 Claims, 5 Drawing Sheets

REPRODUCTION MACHINE HAVING IMAGE DELETIONS REDUCING CONTROL SYSTEM AND METHOD

BACKGROUND OF THE INVENTION

This invention relates generally to electrostatographic reproduction machines, and more particularly concerns such a reproduction machine having a control system and method for reducing halftone image deletions, thereby improving developed halftone image quality.

In the process of electrostatographic printing, a photoconductive surface is charged to a substantially uniform potential. The photoconductive surface is imagewise exposed to record an electrostatic latent image corresponding to the informational areas of an original document being reproduced. Alternatively, a light beam, such as a laser beam may be modulated to expose the charged portion of a photoconductive surface selectively, thereby recording a latent image thereon. In either case, information is recorded as an electrostatic latent image having image areas and background areas on the photoconductive surface. Thereafter, a developer material is transported into contact with the electrostatic latent image. Typical developer materials include carrier granules having toner particles adhering triboelectrically thereto. The toner particles are attracted from the carrier granules of the developer material onto the latent image. The resultant toner powder image is then transferred from the photoconductive surface to a sheet of paper and fused in order to permanently affix it to the sheet of paper. The foregoing generally describes a typical mono-color electrostatographic color reproduction machine.

Recently, electrostatographic color reproduction machines had been developed which produce highlight color copies. A typical highlight color reproduction machine records successive electrostatic latent images on the photoconductive surface. When combined, these electrostatic latent images form a latent image corresponding to the entire original document being printed. One latent image is usually developed with black toner particles. The other latent image is developed with color highlighting toner particles, e.g. red toner particles. These developed toner powder images are transferred sequentially to a sheet of paper to form a color highlighted document that is then fused and affixed to the sheet of paper. A color highlighting color reproduction machine of this type is a two-pass machine. Single pass highlight color reproduction machines using tri-level printing have also been developed. Tri-level electrostatographic printing is described in greater detail in U.S. Pat. No. 4,078,929. As described in this patent, the latent image is developed with toner particles of first and second colors. The toner particles of one of the colors are positively charged and the toner particles of the other color are negatively charged.

In one embodiment, the toner particles are supplied by a developer which comprises a mixture of triboelectrically relatively positive and relatively negative carrier beads. The carrier beads support, respectively, relatively negative and relatively positively charged toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background areas voltage. Such biasing results in a developed image and improves color sharpness.

In tri-level electrostatographic printing, the charge on the photoconductive surface is divided in three, rather than two, ways as is the case in mono-color printing. The photoconductive surface is charged and exposed imagewise such that one image corresponds to the charged areas and remains at the full charged potential. The other image, which corresponds to discharged image areas, is exposed to discharge the photoconductive surface to its residual potential. The background areas are exposed to reduce the photoconductive surface potential to about halfway between the charged and discharged potentials. A developer unit arranged to develop the charged images is typically biased to a potential between the background potential and the full potential. The developer unit, arranged to develop the discharged imaged areas, is typically biased to a level between the background potential and the discharged potential. The single pass nature of this system dictates that the electrostatic latent image passes through the developer unit in a serial fashion.

Another type of color reproduction machine which may produce highlight color copies initially charges the photoconductive member. Thereafter, the charged portion of the photoconductive member is discharged to form an electrostatic latent image thereon having image areas and background areas. The latent image is subsequently developed with black toner particles. The photoconductive member is then recharged and imagewise exposed to record the highlight color portions of the latent image thereon. A highlight latent image is then developed with toner particles of a color other than black, e.g. red then develop the highlight latent image. Thereafter, both toner powder images are transferred to a sheet of paper and subsequently fused thereto to form a highlight color document.

Although only toner particles in each of the machines above are supposed to transfer to the latent image areas, some paper dust, pieces of brush fibers and other mostly airborne particles within the copier or printer, undesirably actually become attracted to, and remain on, the photoconductive surface of the imaging member. Such particles usually result in image defects such as deletions, if transferred along with the desired image at the image transfer station. As such, they are unwanted and should be removed prior to such image transfer. Unwanted particles, which must also be similarly removed include fragments of carrier particles, usually ferromagnetic fragments, which carry individual (wanted) particles of toner, as well as, large agglomerated toner-toner particles or flakes of toner commonly present in the developer housing in development material.

As is well known, toner images made by any of the above processes can be solid images consisting of solid toner color text or graphic image areas having white or undeveloped background areas, or they can be halftone images. A haltone image is different from solid images in that it is composed of a high frequency of varying, alternating solid toner image areas and white or undeveloped background-like areas within the image area itself, as well as white background areas. Although image defects as those mentioned above are a problem with any type of toner image, halftone or tint image defects are particularly a source of customer or operator dissatisfaction, and they occur under certain circumstances when the customer or operator makes a halftone image.

There has therefore been a need for a control system and method for periodically removing unwanted particles from the developer housing of the development apparatus, particularly of highlight color machines that result in halftone image deletions.

SUMMARY OF THE INVENTION

In accordance with the present invention, there is provided an electrostatographic reproduction machine that includes an image bearing member; means for forming a latent image having image areas and background areas; at least a development housing containing charged carrier beads, charged fragments of the charged carrier beads which undesirably cause such image deletions, and charged toner particles for developing image areas to form a toner image; means for transferring the toner image to a sheet of paper; and means for fusing the toner image to the sheet of paper. Importantly the reproduction machine includes a method and control system for reducing halftone image deletions in future halftone images. The method and control system include means for distinguishing latent solid image patterns from latent halftone image patterns; means for counting a number of solid image patterns developed with toner on said image bearing surface; means for providing an electrostatic halftone stress image pattern for electrostatically forming and developing on said image bearing surface; and means for forming and developing a number of the halftone stress image patterns on the image bearing surface, under certain machine operating conditions, so as to attract charged fragments of the charged carrier beads out of the development housing, thereby reducing deletions that would otherwise be undesirably caused by the carrier bead fragments in future halftone toner images.

BRIEF DESCRIPTION OF THE DRAWINGS

Other aspects of the present invention will become apparent as the following description proceeds and upon reference to the drawings in which. invention therein.

DETAILED DESCRIPTION OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
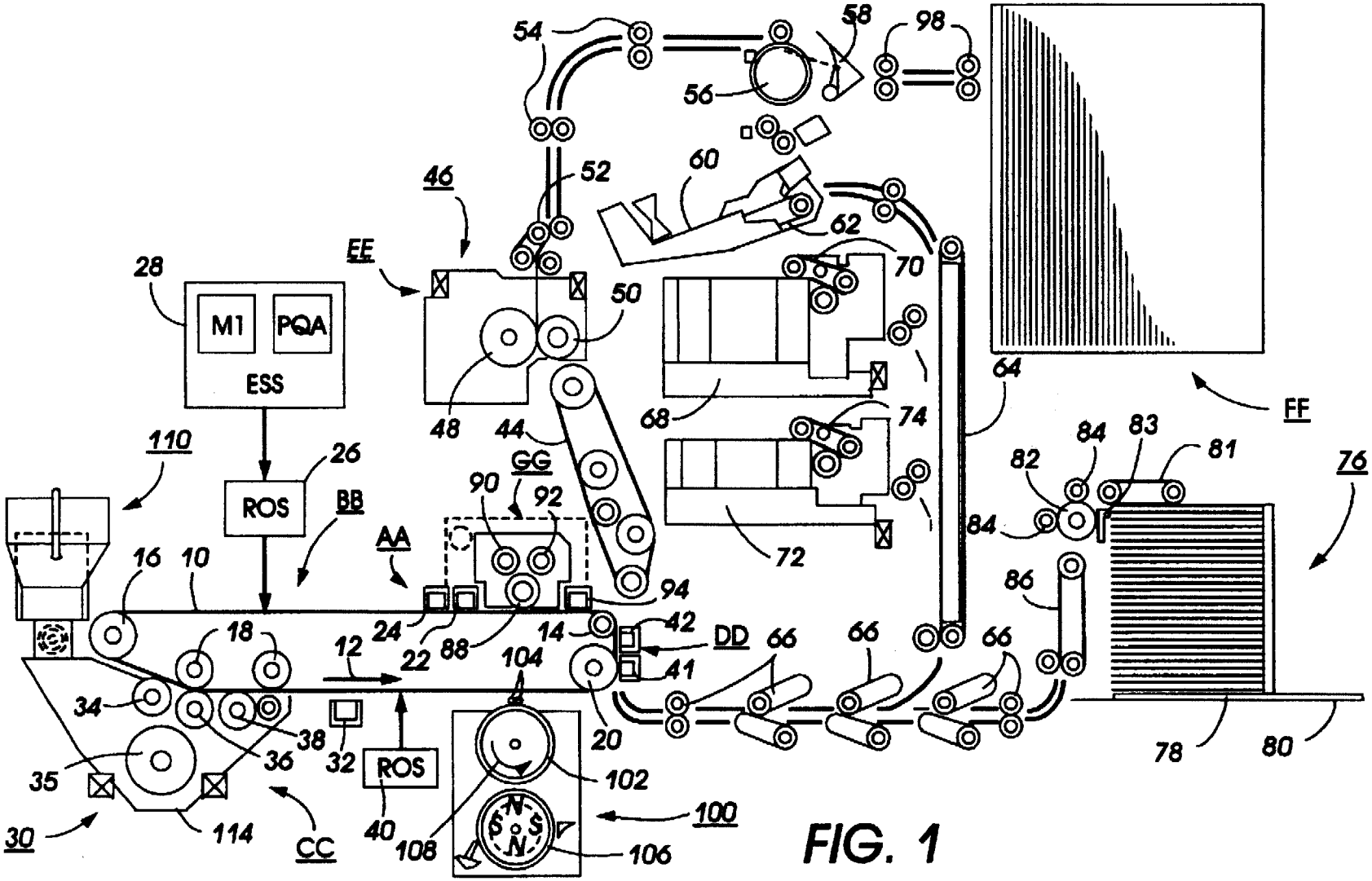
FIG. 1 is a schematic elevational view depicting an illustrative digital electrostatographic color reproduction machine including the halftone image deletion reducing control system and method of the present invention.

For a general understanding of the features of the present invention, reference is made to FIG. 1 which schematically depicts a digital embodiment of an electrostatographic color reproduction machine 8 incorporating the features of the present invention therein. It will become evident from the following discussion that the features of the present invention may be used in a wide variety of production machines and is not specifically limited in this application to the particular embodiment depicted herein.

The electrostatographic color reproduction machine 8 employs a photoconductive belt 10. Preferably, the photoconductive belt 10 is made from a photoconductive material coated on a ground layer, which, in turn, is coated on anti-curl backing layer. The photoconductive material is made from a transport layer coated on a generator layer. The transport layer transports positive charges from the generator layer. The interface layer is coated on the ground layer. The transport layer contains small molecules of di-m-tolydiphenydiphenylbithenyldiamine dispersed in a polycarbonate. The generation layer is made from trigonal selenium. The grounding layer is made from a titanium coated mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station AA. At charging station AA, two corona generating devices, indicated generally by the reference numerals 22 and 24, charge photoconductive belt 10 to a relatively high, substantially uniform potential. Corona generating device 22 places all the required charge on photoconductive belt 10. Corona generating device 24 acts as leveling device, and fills in any areas missed by corona generating device 22.

Next, the charged portion of the photoconductive surface is advanced through imaging station BB. At imaging station BB, the uniformly charged photoconductive surface is exposed by an imager, such as a laser based input and/or output scanning device 26, which causes the charged portion of the photoconductive surface to be discharged in accordance with the output from the scanning device. The scanning device is a laser raster output scanner (ROS). The ROS performs the function of creating the output image copy on the photoconductive surface. It lays out the image in a series of horizontal scan lines with each line having a certain number of pixels per inch. The ROS may include a laser with rotating polygon mirror blocks and a suitable modulator or, in lieu thereof, a light emitting diode array (LED) as a write bar.

A programmable electronic subsystem (ESS) 28, including a memory area M1 and a program subroutine PQA (FIG. 3) of the control system of the present invention (to be described in detail below), is, in part, the control electronics which prepares and manages the image data flow between the data source and the ROS. It may also include a display, user interface and electronic storage, i.e. memory, functions. The ESS as such is actually a self-contained, dedicated mini programmable computer. The photoconductive surface, which is initially charged to a high charge potential, is discharged imagewise in the background areas and remains charged in the image areas in the black parts of the image.

At development station CC, a magnetic brush development system, indicated generally by the reference numeral 30 advances developer material (consisting of charged carrier beads, charged fragments of the charged carrier beads which undesirably cause such image deletions, and charged toner particles), into contact with the electrostatic latent image. The development system comprises three magnetic brush developer rollers, indicated generally by the reference numerals 34, 36 and 38. A paddle wheel 35 picks up developer material from developer sump 114 and delivers it to the developer rollers. When developer material reaches rolls 34 and 36, it is magnetically split between the rolls with half of the developer material being delivered to each roll. Photoconductive belt 10 is partially wrapped about rolls 34 and 36 to form extended development zones.

Developer roll 38 is a magnetic clean-up roll positioned after developer roll 36, in the direction of arrow 12, and operates as a carrier granular removal device adapted to remove any carrier granules adhering to belt 10. Thus, rolls 34 and 36 advance developer material into contact with the electrostatic latent image. The latent image attracts toner particles from the carrier granules of the developer material to form a developed toner powder image on the photoconductive surface of belt 10. Toner dispenser 110 discharges unused toner particles into sump 114. Developer rolls 34 and 36 are substantially identical.

Each of the foregoing developer rollers include a rotating sleeve having a stationary magnetic disposed interiorly thereof. The magnetic field generated by the magnet attracts developer material from paddle wheel 35 to the sleeve of the developer roller. As the sleeve rotates, it advances the developer material into the development zone where toner particles were attracted from the carrier granules to the charged area latent image. In this way, the charged area latent image is developed with these toner or marking particles. The toner particles being employed in developer unit 30 are black. Thus, the charged area latent image is developed by developer unit 30 with black toner particles. The black developed latent image continues to advance with photoconductive belt 10 in the direction of arrow 12.

Corona generator 32 recharges photoconductive surface of belt 10. A second imager, such as ROS 40, which may for example be an LED bar, illuminates the recharged photoconductive surface to selectively discharge the photoconductive surface. The photoconductive surface is discharged in the image areas and charged in the non-image areas to record a discharged latent image thereon. Thereafter, the discharged latent image is developed by a developer unit, indicated generally by the reference numeral 100.

Developer unit 100 includes a donor roll 102, electrode wires 104 and a magnetic roll 106. The donor roll 102 can be rotated in either the (width) or (against) direction relative to the motion of belt 10. The donor roller shown rotating in the direction of arrow 108. Electrode wires 104 are located in the development zone defined as the space between photoconductive belt 10 and donor roll 102. The electrode wires 104 include one or more thin tungsten wires which are lightly positioned against donor roll 102. The distance between wires 104 and donor roll 102 is approximately the thickness of the toner layer on donor roll 102. The extremities of the wires are supported by the tops of end bearing blocks (not shown) which also support donor roll 102 for rotation. An electrical bias is applied to the electrode wires by a voltage source. An AC bias is applied to the electrical wires with the wires being at a DC bias. A voltage source electrically biases the electrode wires with both a DC potential and an AC potential. A DC voltage source establishes an electrostatic field between photoconductive belt 10 and donor roll 102.

In operation, magnetic roll 106 advances developer material comprising carrier granules and toner particles into a loading zone adjacent donor roll 102. The electrical bias between donor roll 102 and magnetic roll 106 causes the toner particles to be attracted from the carrier granules to donor roll 102. Donor roll 102 advances the toner particles to the development zone. The electrical bias on electrode wires 104 detaches the toner particles on donor roll 102 and forms a toner powder cloud in the development zone. The discharged latent image attracts the detached toner particles to form a toner powder image thereon. The toner particles in developer unit 100 are of a color other than black, for example, the toner particles may be red or blue. After the charged area latent image is developed with black toner particles and the discharged area latent image developed with toner particles of a color other than black, belt 10 advances the resultant toner powder image to transfer station DD. At transfer station DD, a sheet or document is moved into contact with the toner powder image. Thus, photoconductive belt 10 is exposed to a pre-transfer light from a lamp (not shown) to reduce the attraction between the photoconductive belt and the toner powder image. Next, a corona generating device 41 charges the sheet to the proper magnitude and polarity as the sheet is passed through photoconductive belt 10. The toner powder image is attracted from photoconductive belt 10 to the sheet. After transfer, a corona generator 42 charges the sheet to the opposite plurality to detack the sheet from belt 10. Conveyor 44 advances the sheet to fusing station EE.

One skilled in the art will appreciate that while developer unit 30 has been described as developing the charged area latent image with black toner particles and developer unit 100 with non-black toner particles, both developer units can develop the respective latent images with black toner particles with the toner particles from one of the developer units being magnetic and the toner particles from the other developer unit being non-magnetic. Moreover, one of the developer units may develop one of the latent images with non-black toner particles while the other developer unit develops the latent image with magnetic toner particles. In this way, the color reproduction machine 8 of the present invention may be used to produce a document having both magnetic and non-magnetic indicia thereon as well as documents having highlight color.

Fusing station EE includes a fuser assembly indicated generally by the reference numeral 46, which permanently affixes the transferred toner powder image to the sheet. Preferably, fuser assembly 46 includes a heated fuser roll 48 and a pressure roll 50 with the powder image on the sheet contacting fuser roll 48. The pressure roll is cammed against the fuser roll to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the sheets are fed through a decurler 52. Decurler 52 bends the sheet in a first direction and puts a known curl in the sheet, and then bends it in the opposite direction to remove that curl.

Forwarding rollers 54 than advance the sheet to duplex turn roll 56. Duplex selenoid gate 58 guides the sheet to the finishing station FF or to duplex tray 60. At finishing station FF, sheets are stacked in a compiler to form sets of cut sheet. The sheets of each set are optionally stapled to one another. The set of sheets are then delivered to a stacking tray. In a stacking tray, each set of sheets may be offset from an adjacent set of sheets.

With continued reference to the FIG. 6, duplex selenoid gate 58 directs the sheet into duplex tray 60. Duplex tray 60 provides an intermediate or buffer storage for those sheets that have been printed on one side on which an image will be subsequently printed on the second, opposed side thereof, i.e. the sheets being duplexed. The sheets are stacked in duplex tray 60 face down on top of one another in the order in which they are being printed.

In order to complete duplex printing, the simplex sheets in tray 60 are fed, in seriatim, by bottom feeder 62 from tray 60 back to transfer station DD via a conveyor 64 and rollers 66 for transfer of the toner powder image to the opposed side of the sheet. Inasmuch as successive sheets are fed from duplex tray 60, the proper or clean side of the sheet is positioned in contact with belt 10 at transfer station DD so that the toner powder image is transferred thereto. The duplex sheet is then fed through the same path as the simplex sheet to be advanced to finishing station FF.

Sheets are fed to transfer station DD from secondary tray 68. Secondary tray 68 includes an elevator driven by a bidirectional AC motor. Its controller has the ability to drive the tray up or down. When the tray is in the down position, stacks of sheets are loaded thereon or unloaded therefrom. In the up position, successive sheets may be fed therefrom by sheet feeder 70. Sheet feeder 70 is a friction retard feeder utilizing a feed belt and take-away rolls to advance successive sheets to transport 64 which advances the sheets to rolls 66 and then to transfer station DD.

Sheets may also be fed to transfer station DD from the auxiliary tray 72. Auxiliary tray 72 includes an elevator driven by bi-directional AC motor. Its controller has the ability to drive the tray up or down. When the tray is in the down position, stacks of sheets are loaded thereon or unloaded therefrom. In the up position, successive sheets may be fed therefrom by sheet feeder 74. Sheet feeder 74 is a friction retard feeder utilizing a feed belt and take-away rolls to advance successive sheets to transport 64 which advances the sheets to rolls 66 and to transfer station DD.

Secondary tray 68 and auxiliary tray 72 are secondary sources of sheets. A high capacity feeder indicated generally by the reference numeral 76, is the primary source of sheets. High capacity feeder 76 includes a tray 78 supported on elevator 80. The elevator is driven by a bi-directional AC motor to move the tray up or down. In the up position, the sheets are advanced from the tray to transfer station DD. A fluffer and air knife directs air onto the stack of sheets on tray 78 to separate the uppermost sheet from the stack of sheets. A vacuum pulls the uppermost sheet against the belt 81. Feed belt 81 feeds successive uppermost sheets from the stack to a take-away drive roll 82 and idler rolls 84. The drive rolls and modular rolls guide the sheet onto transport 86. Transport 86 advances the sheet to roll 66 which, in turn, move the sheet to transfer station DD.

Invariably, after the sheet is separated from photoconductive belt 10, some residual toner particles remain adhering thereto. After transfer, photoconductive belt 10 passes beneath corona generating device 94 which charges the residual toner particles to the proper polarity. Thereafter, a pre-charge array lamp (not shown), located inside photoconductive belt 10 discharges the photoconductive belt in preparation for the next imaging cycle. Residual particles are removed from the photoconductive surface at a single cleaning station GG.

At the single cleaning station GG, residual toner particles are removed by a cleaning apparatus that includes an electrically biased cleaner brush 88 and two detoning rolls 90 and 92. The cleaner brush 88 rotates into cleaning contact with the photoconductive surface to remove and entrain mixed color residual toner particles. The detoning rolls 90, 92 then remove entrained mixed color residual toner particles from the brush 88. The mixed color residual toner particles on the reclaim roller 92 are subsequently scrapped off and then transported out of the cleaning station GG to a collection container or subsequent recovery station (not shown).

Figure 2:
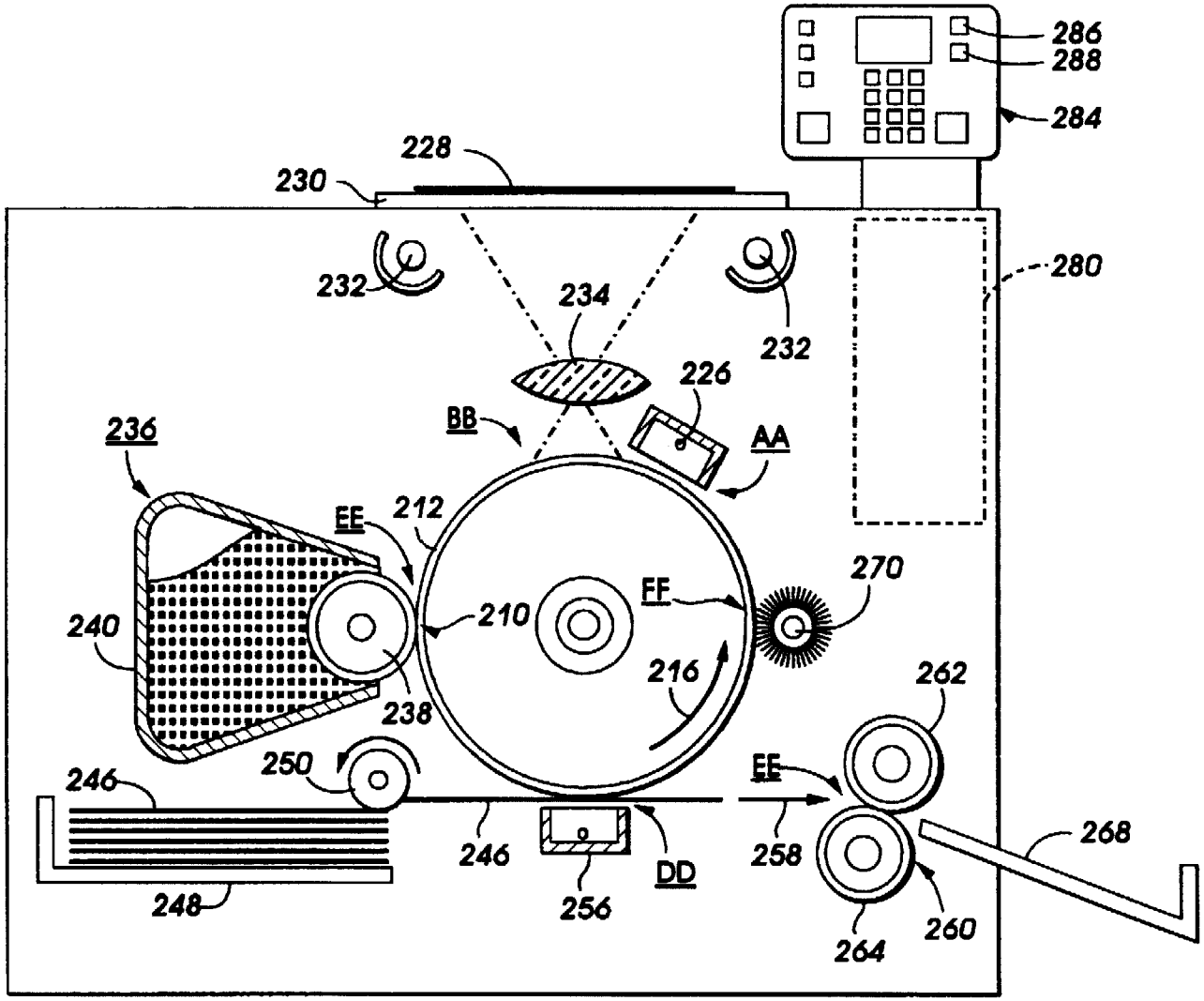
FIG. 2 a schematic elevational view depicting an illustrative light lens electrostatographic reproduction machine including the halftone image deletion reducing control system and method of the present invention.

Referring now to FIG. 2, a second, light lens, embodiment of an exemplary electrostatographic reproduction machine incorporating a semi-automatic embodiment of the method and context system of the present invention is illustrated. The exemplary machine, for example, employs a photoreceptive member shown as a drum 210 including a photoconductive surface 212. As is well known, the photoconductive member can equally be a suitably mounted belt having a photoconductive surface. The photoconductive drum 210 is coupled to motor (not shown) for rotation about a process path in the direction of arrow 216 for advancing successive portions of photoconductive surface 212 through various processing stations disposed about the process path. Initially, a surface portion of drum 210 passes through a charging station AA. At charging station AA, a corona generating device 226 charges photoconductive surface 212 to a relatively high and substantially uniform potential.

Once charged, photoconductive surface 212 is advanced to an imaging station BB where an original document 228 having image areas and background areas, positioned face down on a transparent platen 230, is exposed to light from light sources, such as lamps 232. Light rays from the lamps 232 are reflected imagewise from the document 228 thus forming a light image of the original document 228. The reflected rays are transmitted through a lens 234 and focused onto a portion of the charged photoconductive surface 212, thus selectively dissipating the uniform charge on impacted areas thereof. As such, an electrostatic latent image having image areas and background areas corresponding to the original document 228 is recorded onto photoconductive surface 212.

After the electrostatic latent image is recorded on photoconductive surface 212, drum 210 advances to development station CC where a development apparatus 236, deposits developing material containing charged toner particles onto the electrostatic latent image. Development apparatus 236 for example may include a single developer roller 238 disposed in a developer housing 240 containing developer material consisting of charged carrier beads, charged fragments of the charged carrier beads which undesirably cause such image deletions, and charged toner particles. The developer roller 238 rotates, bringing the developing material into contact with photoconductive surface 212, thus developing the latent image into a visible toner image. After development of the electrostatic latent image as such, drum 210 advances the toner image to transfer station DD.

At transfer station DD, a sheet of support material 246 is moved into contact with the toner image by means of a sheet feeding apparatus 248. Preferably, sheet feeding apparatus 248 includes a feed roller 250 which rotates while in contact with a stack of sheets 246 to advance the uppermost sheet. The advancing sheet of support material 246 is moved into contact with photoconductive surface 212 of drum 210 at transfer station DD in a timed sequence so that the developed toner image on the surface 212 contacts the advancing sheet of support material 246, and is transferred. A transfer corotron 256 is provided for projecting ions onto the backside of sheet 246 in order to induce the transfer of charged toner images from the photoconductive surface 212 onto support material 246. The support material 246 is subsequently transported in the direction of arrow 28 for advancement to a fusing station EE.

Fusing station EE includes a fuser assembly 260 for heating and permanently affixing the transferred toner image to sheet 246. Fuser assembly 260 preferably includes a heated fuser roller 262 and a support roller 64 forming a fusing nip for receiving and transporting a sheet of support material 246 therethrough. After fusing, the advancing sheet of support material 246 is moved to a receiving tray 268 for subsequent removal of the finished copy by an operator.

Invariably, after the support material 246 was separated from the photoconductive surface 212 of drum 210, some residual developing material remained adhered to drum 210. Thus, a final processing station, namely cleaning station FF including a cleaning device 70, such as a brush, is provided for removing residual toner particles from photoconductive surface 212 in preparation for subsequent charging and imaging as described above. Further, in accordance with the present invention, two patterns of the halftone stress image of the present invention, that are not transferred to support material and removed directly from the surface 20.

Figure 3:
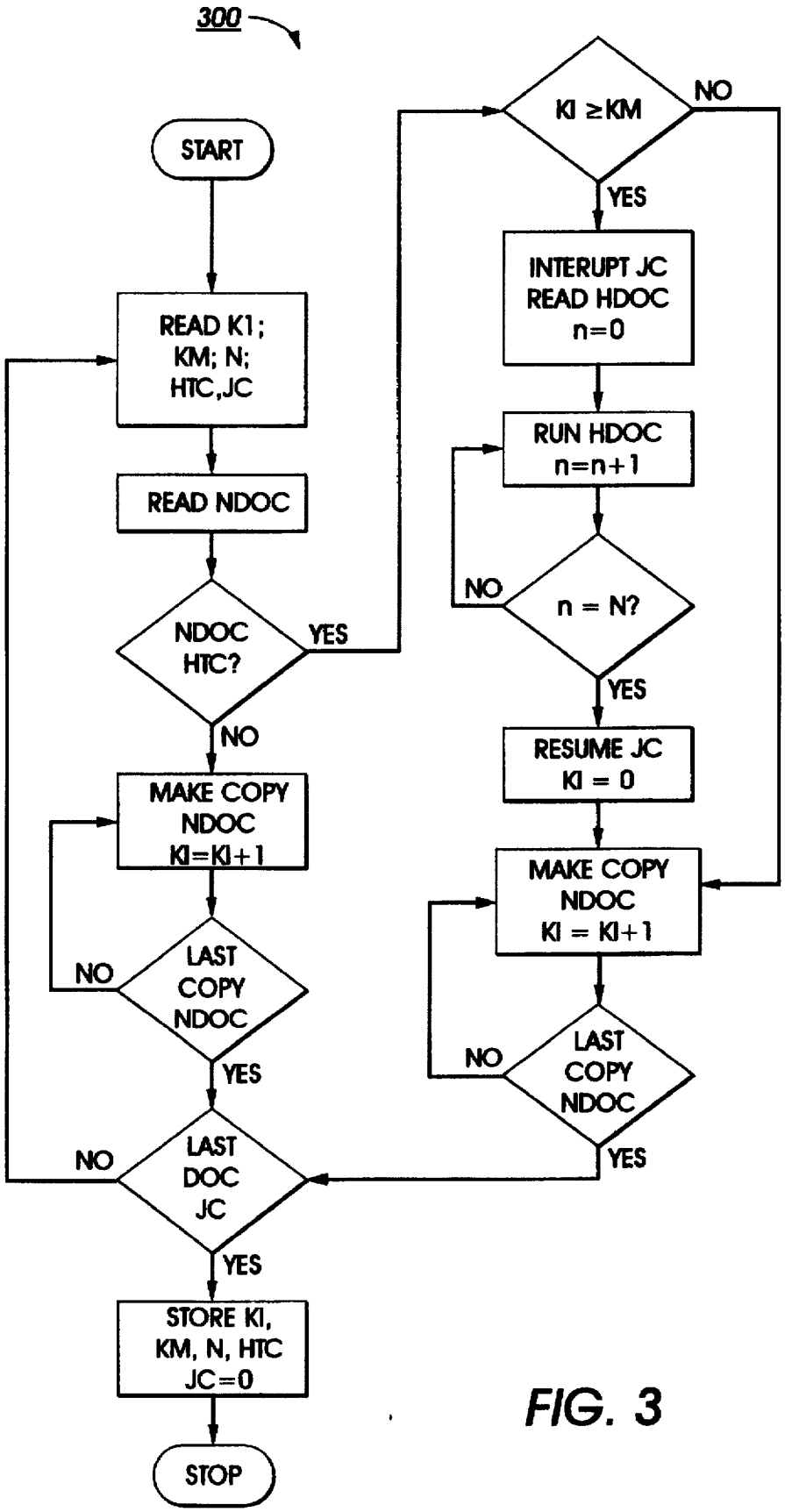
FIG. 3 is a flow chart of an automatic diagnostic routine of the method and control system of the present invention for use with the digital reproduction machine of FIG. 1.
Figure 4:
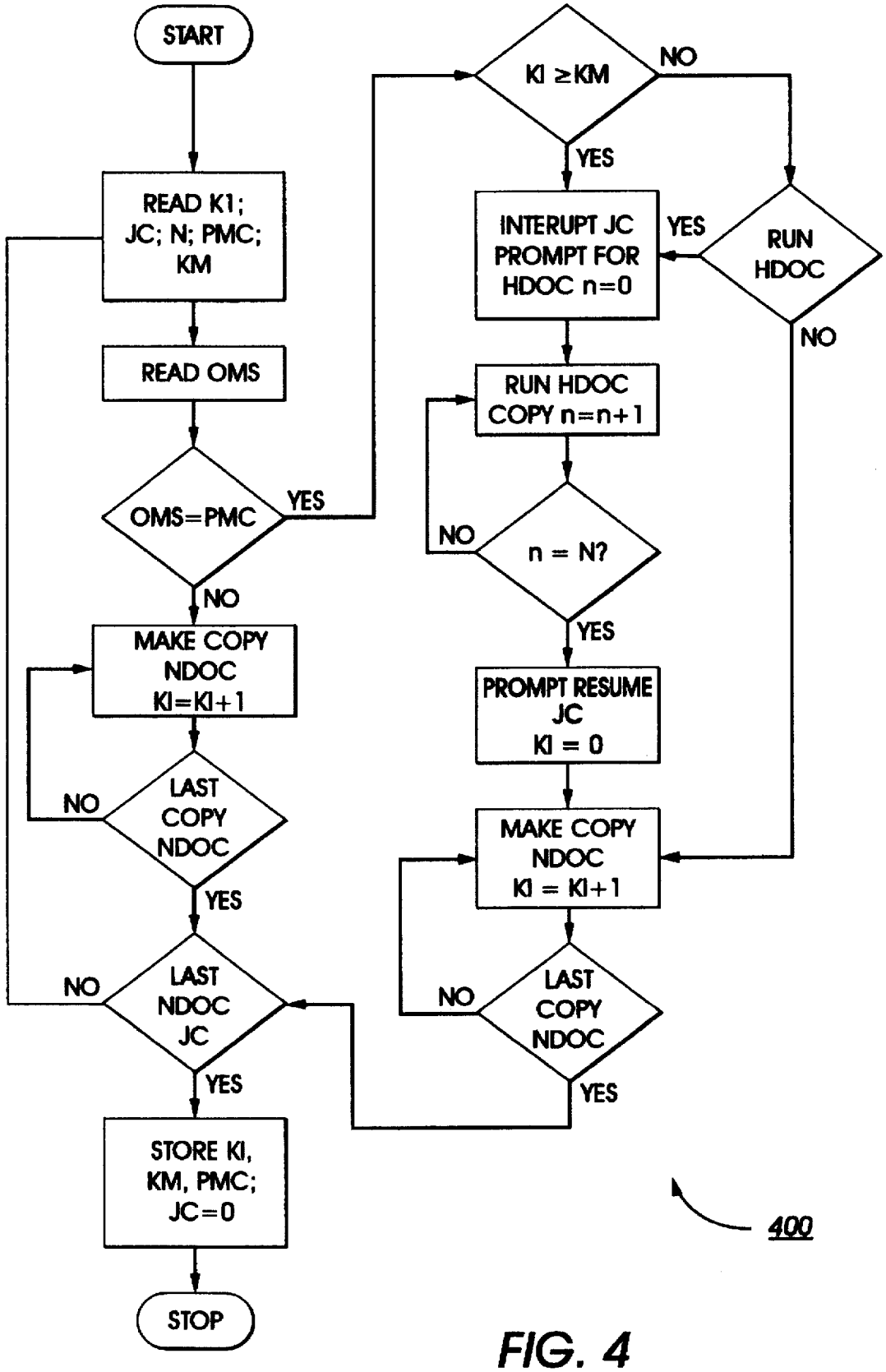
FIG. 4 is a flow chart of a semi-automatic diagnostic routine of the method and control system of the present invention for use with the light lens reproduction machine of FIG. 2.

Referring now to FIGS. 3 and 4, two embodiments or approaches to the control system and method of the present invention are illustrated for reducing halftone image deletions, thereby improving developed halftone image quality. As pointed out above, single color or multicolor toner images made by either of the machine processes above, can be solid images having solid toner-color text or graphic image areas with white or undeveloped background areas, or they can be halftone images. Again, halftone images are different from solid images in that besides having actual background areas, a halftone image is composed of a high frequency of alternating solid toner image areas and white or undeveloped background-like areas within the halftone image itself. For example, all but the smallest English character fonts can be considered solid image, as far as the present invention is concerned. On the other hand, Kanji characters, and extremely small fonts, would act like halftone images.

A halftone image deletion defect is a white circle approximately 1–5 mm in diameter in the middle of the halftone image area itself. It has been found that each such deletion is caused by a carrier bead fragment that undesirably developed, or that was transferred onto the halftone image during development. As is well known, the carrier bead is usually made of non-compressible and non-fusible material, and has a larger diameter than a toner particle. For example, some toners include toner particles that each have a diameter of about 12 microns, while carrier beads typically each have a diameter of 120 microns. Deletions as above are, however, most likely to be caused by a bead fragment, which may have a relatively smaller diameter of about 20–50 microns.

When the toner developed halftone image that undesirably received such carrier fragments during development is being transferred from the photoreceptor or image bearing surface onto a sheet of paper at transfer station DD, the carrier bead fragment undesirably prevents full transfer by becoming sandwiched between, and lifting, a portion of the paper from the photoreceptor. Even in cases where a transfer blade is used at the transfer station DD to press the paper against the photoreceptor, such a carrier fragment because it is non-compressible, equally prevents full transfer by spacing the paper and blade from the photoreceptor. Therefore, in the region around the carrier bead fragment, no toner transfers, and the result is a white space on the paper. This is sometimes called a "tent" deletion, because the paper forms a "tent" with the carrier bead at the center. The diameter of each such deletion depends on the size of the carrier bead fragment. Larger bead fragments lift the paper higher, and thus form a larger diameter tent and deletion.

Although image deletions as such can happen on any type of image, they are most likely to occur more often in halftone images for the following reasons. Typically, carrier beads are charged oppositely to the toner particles, for example, they will be charged positively when the toner is charged negatively. This means that areas of the photoreceptor (image areas) which are charged to attract toner, will tend to repel oppositely charged carrier beads. In the development of solid images (as described above) deletions (as described above) are therefore unlikely to occur within such solid image areas because the solid image area will tend to repel the carrier beads. The same carrier however would be attracted instead to the relatively oppositely charged background areas of the solid image, because background areas are controlled to repel the toner.

Because of the opposite charge, a carrier bead which is transferred to the photoreceptor in a background or solid area of a solid image will ordinarily become discharged, thus becoming neutral in its charge. Since there is no longer any electrostatic force holding the bead onto the photoreceptor as a consequence of being discharged, the carrier bead is easily pulled off by the magnetic fields in the development housing, or by a carrier bead pick-off magnet. In addition, fragments of carrier beads being attracted to such background areas of solid images are not a problem because any white deletions they cause in a white background area will essentially be invisible.

However, because a halftone image is comprised of solid areas and background-like white areas within the image itself, there are therefore areas of the halftone image (the background-like white areas thereof) that like the background areas of solid images) will tend to attract carrier beads. Because of the existence of solid areas and background like areas, a halftone image as such is developed by applying a high frequency of varying development fields (which cause toner to transfer) and cleaning fields (which cause toner not to transfer). As discussed above, a carrier bead which undesirably transfers to the photoreceptor during development into an area of a halftone image will ordinarily also be discharged. However, because such a carrier bead is conductive, the application of alternating development and cleaning fields during development of the halftone image will instead induce a dipole in the carrier bead. Unlike the case with solid images, this dipole within the halftone image will have an electrostatic attraction to the photoreceptor, and will thus be less likely to be pulled off the photoreceptor by the magnetic fields in the system. Therefore, the bead conductivity and the varying fields tend to make carrier bead fragments more likely to stick to, and remain on, the photoreceptor in halftone image areas. It should be noted too that a large carrier bead is more likely to be pulled off than is a bead fragment, because the magnetic attraction is a power of the bead radius. Bead fragments are thus the principal source of the deletions.

Some bead fragments are present in the initial charge of developer material. Additional bead fragments however are generated as the carrier beads in the development housing tumble and grind against each other during developer material mixing. Therefore, as the material ages, more and more fragments accumulate due to developer mixing action in the housing. As such, bead fragments are generated at a nearly constant rate in the development housing of each electrostatographic reproduction machine.

As pointed out above, solid images when run do not pull out or attract such bead fragments. It has been found that when a halftone image is run for the dipole rational, the halftone image undesirably pulls out the fragments. Therefore, if a customer or operator of a machine runs halftone images most of the time, the bead fragments generated in the development housing will be pulled out of the housing and onto the photoreceptor at a slow, steady rate, with each such image. The level of image deletions per halftone image is therefore generally tolerable and not a source of customer dissatisfaction. For halftone images having at least 11% solid area coverage each, the goal for customer acceptance and satisfaction is 25 or less deletions per 1000 sheets of such images. However, if one such halftone image is run after a long period of running a large quantity, say 210,000, of solid images, a lot of these fragments undesirably will develop onto the one such halftone image.

The control system of the present invention therefore employs a large area coverage halftone stress image pattern that when run after a long period of solids will pull such bead fragments out of the development housing, thereby reducing the number of such fragments left within the development housing. When a halftone image or document is finally run following a period of running a lot of solid images, bead fragments will undesirably be pulled out, thus causing image deletions as described above. It has been found that such bead fragments are more likely to be pulled out of the developer housing whenever the toner concentration (tc) within the housing is below approximately 2.5%.

Figure 5:
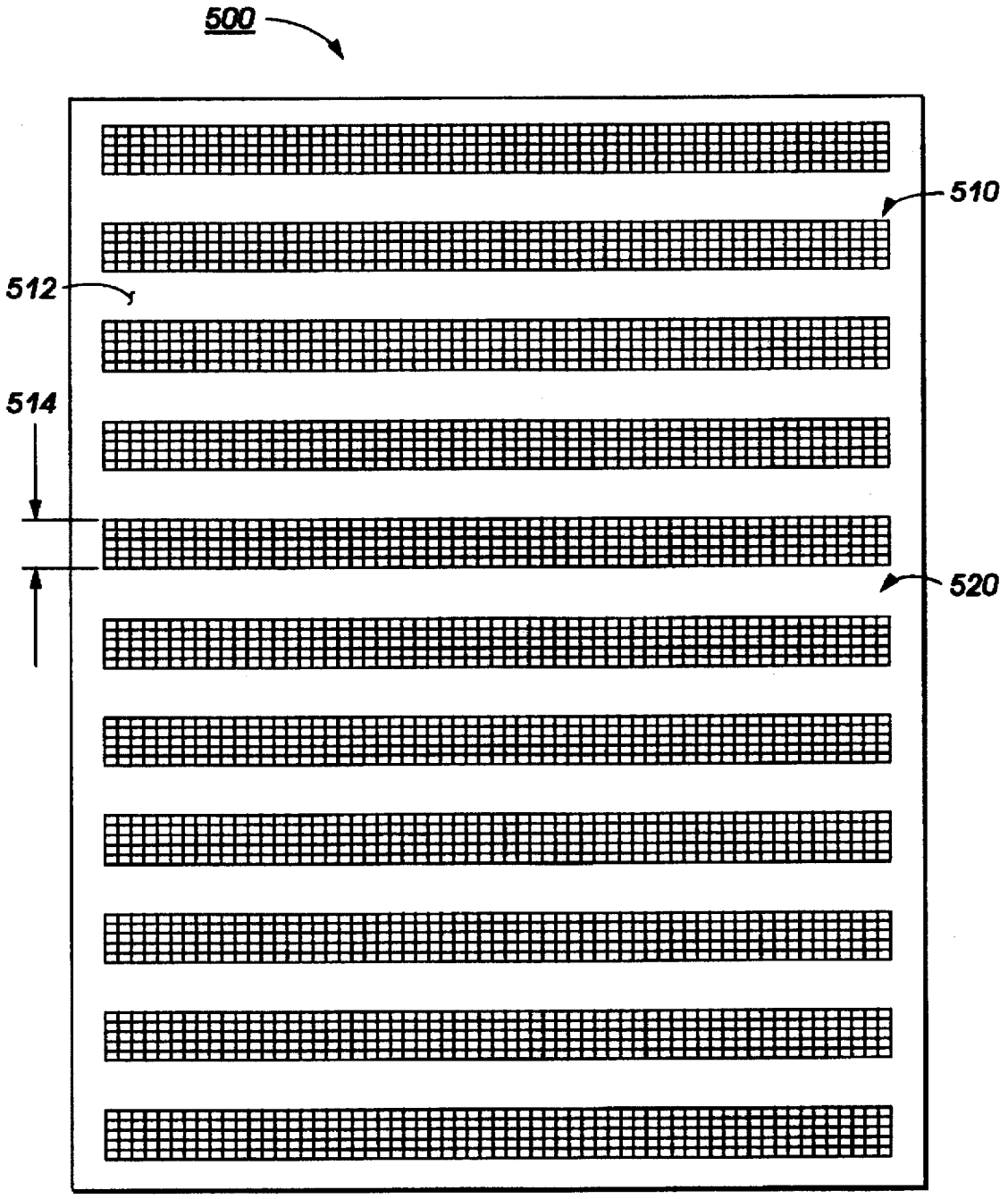
FIG. 5 is an illustration of a high frequency halftone stress image pattern for use in the control system and method of the present invention.

In accordance with the present invention, halftone image deletions caused by charged fragments of charged carrier beads from the developer housing, are reduced through an automatic machine diagnostic programmed routine 300 (FIG. 3), or through a semi-automatic routine 400 (FIG. 4) that is actually run with the help of a machine operator. Referring now to FIGS. 1, 3 and 5, the automatic machine diagnostic programmed routine 300 is part of the electronic control subsystem (ESS) 28. As is well known, the ESS 28 in a digital reproduction machine can include, and preferably includes for this invention, means for distinguishing latent solid image patterns from latent halftone image patterns which are to be formed and developed in a manner as described above. The ESS 28 also includes counting means for keeping count of a number of solid toner images formed on the image bearing surface, as well as a memory area M1 for storing usable control and image data.

Importantly, in accordance with the present invention, the memory area M1 includes stored data of a stress image consisting of an electrostatic halftone stress image pattern (FIG. 5) for electrostatically forming and developing on the image bearing surface. In addition, the ESS 28 of the present invention includes instruction steps of the programmed routine 300 for automatically forming and developing a number of the halftone stress image pattern on the image bearing surface, under certain machine operating conditions, so as to attract charged fragments of charged carrier beads out of the development housing 30, 100 of the machine 8, for example. Running the halftone stress image pattern, as such, has been found to effectively reduce image deletions that would otherwise be caused undesirably by carrier bead fragments in future halftone toner images.

As illustrated in FIG. 3, K1 is a cumulative number or count of solid toner images run since a last running of the routine 300; KM is a control number, for example, 210,000, for such count K1; HTC is a halftone image pattern recognition code or signal; JC is the number of documents in a job to be run. NDOC is the next document, and HDOC is the halftone stress image pattern. When a document to be run is not a halftone image document, the machine will run as many copies of the document as selected, meantime increasing the count K1, until the last document of the job is run. The control system then stores the control values including a new K1 value. However, if when running the job, JC, one of the documents to be run is a halftone image document, (recognized as HTC), the system will check to see if K1 has reached or exceeded KM. If not, the system will run as many copies of that document as selected, meantime also increasing the count K1, until the last document of the job is run. If on the other hand, K1 was equal or had exceeded KM, the system will interrupt the job JC, read the stored data of the halftone stress image pattern HDOC from memory area M1, and run N (20–250) copies of it, before resuming the job JC. K1 as shown is reset to zero following each running of the stress halftone image pattern HDOC as such.

This routine is preferably run without transferring the toner developed stress document pattern HDOC to a sheet of paper, and hence no waste image paper is delivered to the output trays. The diagnostic routine as such can do even more to cleanse the developer housings of undesirable fragments of carrier beads that cause deletions, if in a two color machine as the machine 8, the development bias of the black developer housing is increased. This increases the cleaning fields for the black development bias, which pulls even an increased number of black bead fragments out of the black developer housing.

Referring now to FIGS. 2, 4 and 5, halftone image deletions caused by charged fragments of charged carrier beads from the developer housing, can also be reduced, this time through the semi-automatic routine 400 (FIG. 4) that is run on a light lens reproduction machine, preferably one having a pictorial or photo mode of operation for making halftone image reproductions. The semi-automatic routine 400 is actually run with the help of a machine operator or customer. The light lens reproduction machine according to the present invention is provided with a hard copy document of the halftone stress image pattern of FIG. 5. As illustrated in FIG. 4, the machine prompts or queries the operator (as to whether the operator wants to run the stress document), whenever the operator selects the photo or pictorial mode of machine operation. If the operator decides to run the stress document, for example, based on observed deletions, the semi-automatic routine thereafter is the same as in the case of a digital machine as described above when the operator starts running the stress document. In each case, a quantity of the stress document is run, thereby placing a stress on the development process and "calling out" or removing bead fragments and agglomerates from the developer housing. In each case, it is preferable that the quantity run of the stress document be more than 20, but less than 250, for example. Because the toner images or imprints of the stress document need not be transferred to sheets of paper, the entire cleansing or purging action by the stress document is transparent to the customer, with no waste paper generated.

Thus, the light lens copier of the present invention includes a control subsystem 280 that has a selectable photo or pictorial mode for use in forming and developing halftone image patterns, and an operator control panel 284 that includes means, such as a button 286 for selecting the photo mode. As in the case of the digital machine, the control system also includes counting means for counting a number of solid toner images formed on the image bearing surface, and prompting means for prompting an operator to run a number of the halftone stress image patterns under certain machine operating conditions. Preferably, the operator is so prompted when the pictorial or photo mode button, for example, is selected. As further illustrated, the control system includes interrupt means 288 for interrupting a job being run in order to prompt an operator to run the halftone stress image document.

Referring in particular to FIG. 5, the electrostatic halftone stress image pattern or document 500 consists of rapidly alternating solid image areas 510 requiring application of a development field to develop with toner, and background areas 520 requiring application of a cleaning field opposite to the development field of the solid image areas. The electrostatic halftone stress image pattern, when formed on the image bearing surface, preferably has an area coverage ratio of less than 30% of an image frame of the image bearing surface; and its pattern importantly consists of 50% solid image areas and 50% background areas so as to exhibit rapid changing development and cleaning fields during formation. Such rapid changing fields are what stress the development system, causing the effective pulling out of undesirable charged fragments of carrier beads, as described above.

As shown, the solid image areas 510 and the background areas 510 each consist of a linear array of bar patterns 512 arranged horizontally. The bars 512 can also be aligned in the perpendicular direction. The solid image areas 510 alternatively could equally be halftone squares that are sprinkled around an area being covered, and as such define square-shaped alternating background areas. The important factors are that the patterns be rapidly alternating, and that the total area coverage of solid image areas stay below 30% of the covered area. It is also preferable that each bar pattern 52, for example, of the linear arrays, has a bar width 514 or greater than one pixel so as to minimize a quantity of good toner particles that would be pulled out along with the charged fragments of charged carrier beads, during development of the halftone stress image pattern 500.

The following is a brief description of the method of reducing halftone image deletions in halftone images run on the reproduction machine of the present invention. The reproduction machine as described has a development housing containing charged fragments of charged carrier beads which undesirably cause such image deletions. As illustrated in FIGS. 3 and 4, the method includes the steps of distinguishing latent solid image patterns from latent halftone image patterns; counting a number of solid image patterns developed with toner on the image bearing surface; and providing a halftone stress image pattern for electrostatically forming and developing on the image bearing surface. In the case of a light lens copier, the halftone stress image pattern is provided as a hard copy document that an operator is prompted to place on the platen and to run through the development stage.

The method next includes forming and developing a number of the halftone stress image pattern on the image bearing surface, under certain machine operating conditions, so as to attract the charged fragments of the charged carrier beads out of the development housing, thereby reducing deletions that would otherwise be undesirably caused by the carrier bead fragments in future halftone toner images.

Bead fragment removal however, is most efficient when the stress image run comprises a halftone image that has approximately the same amount of white areas and color or solid areas. A preferred compromise is to use a mid-density halftone image or print consisting of stripes or bars (FIG. 5) that run across the page. This will be effective without consuming more good toner than is necessary. Since carrier bead fragments are held to the photoreceptor by the rapidly varying development and cleaning fields in halftone images, any document in which solid areas and white areas are rapidly alternated would remove bead fragments from the housing. In fact it is possible to successfully remove bead fragments as such using alternating solid color and white single-pixel lines, or even somewhat lighter or darker halftone images, however, a 50% halftone image consisting of equal numbers of white pixel width lines and color pixel width lines over an entire page was found to remove too much good toner from the developer housing. Following such a period of time, the system of the present invention either automatically initiates, or semi-automatically prompts the customer or operator to run the stress document. Such prompting for example can be programmed to occur when KM is equal to 210,000 images or prints.

While the embodiment disclosed herein is preferred, it will be appreciated from this teaching that various alternative, modifications, variations or improvements therein may be made by those skilled in the art, which are intended to be encompassed by the following claims:

What is claimed is:

1. A digital reproduction machine comprising:

(a) a movable image bearing member having an image bearing surface including image frame portions;

(b) means for electrostatically forming, in image frame portions of on said image bearing surface, latent solid image patterns, and latent halftone image patterns, each having image areas and background areas;

(c) a development housing containing developer material consisting of charged carrier beads, charged fragments of said charged carrier beads that undesirably cause image deletions in halftone toner images, and charged toner particles for developing image areas of image patterns to form solid toner images and halftone toner images;

(d) means for transferring the toner images onto sheets of paper;

(e) means for fusing the toner images on the sheets of paper to form hard copy images; and (f) an electronic control subsystem including:

(i) means for distinguishing latent solid image patterns from latent halftone image patterns;

(ii) counting means for counting a number of solid toner images formed on said image bearing surface;

(iii) a memory area for storing usable control data, said memory area including a stress image stored data comprising an electrostatic halftone stress image pattern for electrostatically forming and developing on said image bearing surface; and (iv) a programmed routine for automatically forming and developing a number of said halftone stress image pattern on said image bearing surface under certain machine operating conditions, so as to attract charged fragments of said charged carrier beads out of said development housing, thereby reducing halftone image deletions undesirably being caused by said carrier bead fragments.

2. The digital reproduction machine of claim 1, wherein said electrostatic halftone stress image pattern consists of rapidly alternating solid image areas requiring application of a development field to develop with toner, and background areas requiring application of a cleaning field opposite to the development field of the solid image areas.

3. The digital reproduction machine of claim 2, wherein said electrostatic halftone stress image pattern, when formed on said image bearing surface, has an area coverage ratio of less than 30% of an image frame of the image bearing surface.

4. The digital reproduction machine of claim 3, wherein said electrostatic halftone stress image pattern consists of 50% solid image areas and 50% background areas.

5. The digital reproduction machine of claim 4, wherein said solid image areas and said background areas each consist of a linear array of bar patterns.

6. The digital reproduction machine of claim 5, wherein each bar pattern of said linear array has a bar width greater than one pixel so as to minimize a quantity of good toner particles pulled out along with said charged fragments of said charged carrier beads during development of said halftone stress image pattern.

7. The digital reproduction machine of claim 1, wherein said programmed routine is automatically initiated whenever a future halftone toner image is to be run following a period of running a certain number of solid toner images.

8. A method of reducing halftone image deletions in future halftone images run on a reproduction machine having a development housing containing developer material consisting of charged carrier beads, charged fragments of the charged carrier beads which undesirably cause such image deletions, the method comprising the steps of:

(a) distinguishing latent solid image patterns from latent halftone image patterns;

(b) counting a number of solid image patterns developed with toner on said image bearing surface;

(c) providing an electrostatic halftone stress image pattern for electrostatically forming and developing on said image bearing surface; and (d) forming and developing a number of said halftone stress image pattern on said image bearing surface under certain machine operating conditions, so as to attract charged fragments of said charged carrier beads out of said development housing, thereby reducing deletions that would otherwise be undesirably caused by the carrier bead fragments in future halftone toner images.

9. A light lens reproduction machine comprising:

(a) (a) a movable image bearing member having an image bearing surface including image frame portions;

(b) means for electrostatically forming, in image frame portions of said image bearing surface, latent solid image patterns, and latent halftone image patterns, each having image areas and background areas;

(c) a development housing containing developer material consisting of charged carrier beads, charged fragments of said charged carrier beads that undesirably cause image deletions in halftone toner images, and charged toner particles for developing image areas of image patterns to form solid toner images and halftone toner images;

(d) means for transferring the toner images onto sheets of paper;

(e) means for fusing the toner images on the sheets of paper to form hard copy images; and (f) a control subsystem including (i) a selectable photo mode for use in forming and developing halftone image patterns;

(ii) an operator control panel including means for selecting said photo mode;

(iii) counting means for counting a number of solid toner images formed on said image bearing surface;

(iv) a stress image comprising an electrostatic halftone stress image pattern available to an operator on said machine for running by electrostatically forming and developing on said image bearing surface; and (v) prompting means for prompting an operator to run a number of said halftone stress image pattern on said image bearing surface under certain machine operating conditions, so as to attract charged fragments of said charged carrier beads out of said development housing, thereby reducing halftone image deletions undesirably being caused by said carrier bead fragments.

10. The reproduction machine of claim 9, including interrupt means for interrupting a job being run in order to prompt an operator to run said electrostatic halftone stress image pattern.

* * * * *